US011235840B2

(12) United States Patent
Oesmann et al.

(10) Patent No.: US 11,235,840 B2
(45) Date of Patent: Feb. 1, 2022

(54) DEVICE AND METHOD FOR LIFTING A WATERCRAFT USING A CHAIN

(71) Applicants: thyssenkrupp Marine Systems GmbH, Kiel (DE); thyssenkrupp AG, Essen (DE)

(72) Inventors: Hans Oesmann, Hamburg (DE); Sebastian Halfmann, Norderstedt (DE); Ronja Bues, Hamburg (DE)

(73) Assignees: thyssenkrupp Marine Systems GmbH, Kiel (DE); thyssenkrupp AG, Essen (DE)

( * ) Notice: Subject to any disclaimer, the term of this patent is extended or adjusted under 35 U.S.C. 154(b) by 71 days.

(21) Appl. No.: 16/764,036

(22) PCT Filed: Nov. 12, 2018

(86) PCT No.: PCT/EP2018/080871
§ 371 (c)(1),
(2) Date: May 14, 2020

(87) PCT Pub. No.: WO2019/101553
PCT Pub. Date: May 31, 2019

(65) Prior Publication Data

US 2020/0283100 A1 Sep. 10, 2020

(30) Foreign Application Priority Data

Nov. 23, 2017 (DE) ..... 10 2017 220 932.1

(51) Int. Cl.
*B63B 23/40* (2006.01)
*B63B 23/30* (2006.01)
(Continued)

(52) U.S. Cl.
CPC ..... *B63B 23/40* (2013.01); *B63B 23/30* (2013.01); *B63B 27/22* (2013.01); *B63B 27/36* (2013.01)

(58) Field of Classification Search
CPC ..... B63B 23/00; B63B 23/30; B63B 23/32; B63B 23/34; B63B 23/40; B63B 27/00;
(Continued)

(56) References Cited

U.S. PATENT DOCUMENTS 8,671,866 B2 * 3/2014 Peuziat ..... B63B 23/34 114/258
8,752,494 B2 * 6/2014 Soreau ..... B63B 27/143 114/259
(Continued)

FOREIGN PATENT DOCUMENTS

DE 39 38 1 88 A 2/1991
DE 102011109092 A 2/2013
(Continued)

OTHER PUBLICATIONS

English Translation of International Search Report issued in PCT/EP2018/080871, dated Jan. 29, 2019.

*Primary Examiner* — Daniel V Venne
(74) *Attorney, Agent, or Firm* — thyssenkrupp North America, LLC

(57) ABSTRACT

A recovery apparatus and a recovery method is disclosed for recovering a watercraft, in particular for recovering a boat on board a mother ship. A frame actuator pulls a frame of the recovery apparatus relative to a carrying structure from a recovering position into a parked position. A chain drive moves a chain relative to the frame along a closed curve. The chain comprises at least one driver. A watercraft to be recovered is connected temporarily to the chain and is pulled out of the water by the movement of the frame relative to the
(Continued)

carrying structure and by the movement of the chain having the drivers relative to the frame.

25 Claims, 10 Drawing Sheets

(51) Int. Cl.
*B63B 27/22* (2006.01)
*B63B 27/36* (2006.01)

(58) Field of Classification Search
CPC ..... B63B 27/14; B63B 27/16; B63B 27/18; B63B 27/19; B63B 27/22; B63B 27/28; B63B 27/29; B63B 27/30; B63B 27/36
USPC ..... 114/268, 365, 366, 375
See application file for complete search history.

(56) References Cited

U.S. PATENT DOCUMENTS

| | | | | |
|---|---|---|---|---|
| 8,821,066 | B1 * | 9/2014 | Caccamo | B63B 35/40 405/1 |
| 8,967,067 | B2 * | 3/2015 | Soreau | B63B 21/10 114/259 |
| 9,522,715 | B1 * | 12/2016 | Gerard | B63B 27/14 |
| 9,598,149 | B1 * | 3/2017 | Conn | B63B 27/36 |
| 9,969,470 | B2 * | 5/2018 | Brizard | G01V 1/3852 |
| 10,232,915 | B2 * | 3/2019 | Jourdan | B63B 23/32 |
| 10,266,233 | B2 * | 4/2019 | Dishon | B63B 27/143 |
| 2008/0202405 | A1 | 8/2008 | Kern | |
| 2014/0116312 | A1 | 5/2014 | Kalwa | |

FOREIGN PATENT DOCUMENTS

| | | | |
|---|---|---|---|
| JP | S62-26189 | A | 2/1987 |
| JP | 2007038706 | A | 2/2007 |

* cited by examiner

DEVICE AND METHOD FOR LIFTING A WATERCRAFT USING A CHAIN

CROSS REFERENCE TO RELATED APPLICATIONS

This application is a U.S. National Stage Entry of International Patent Application Serial Number PCT/EP2018/080871, filed Nov. 12, 2018, which claims priority to German Patent Application No. DE 10 2017 220 932.1, filed Nov. 23, 2017, the entire contents of both of which are incorporated herein by reference.

FIELD

The present disclosure generally relates to a recovery apparatus and to a recovery method for recovering at least one watercraft using a chain.

BACKGROUND

JP S62-26189 A describes a recovery apparatus of a ship 1, which can recover a plurality of dinghies 2 one after another and can put them back into the water, cf. FIG. 1. Each dinghy 2 has a centrally attached nose or hook 10 on the keel close to the bow, cf. FIG. 4 and FIG. 5, and travels toward the ship 1 from the side at a right angle. The nose or hook 10 catches in a driven chain 8 having drivers, cf. FIG. 3 and FIG. 5. The driven chain 8 pulls the dinghy 2 out of the water (in FIG. 1 from left to right) and then through a tunnel 3. This tunnel 3 passes transversely through the ship 1 and has an obliquely rising inlet 4, an obliquely falling outlet 5 and a plateau 7 between the inlet 4 and the outlet 5, cf. FIG. 1. A dinghy 2 is guided by a plurality of guide rollers 9 while it is being pulled through the tunnel 3, cf. FIG. 2 and FIG. 3.

JP 2007-038706 A describes a mother ship 1, which can recover a boat 3 with the aid of a ramp 2a, cf. FIG. 1. The boat 3 travels on an obliquely rising conveyor device 5. The conveyor device 5 comprises a conveyor belt 5a with protrusions 5b and pulls the boat 3 out of the water and onto the ramp 2a by means of the conveyor belt 5a. In that case, the conveyor belt 5a is located centrally beneath the boat 3. Protrusions 5b of the conveyor belt catch in each case one hook 3a on the underside of the boat 3.

FIG. 1 of DE 10 2011 109 092 A1 shows a system 1 that is mounted on board a ship 8 and is capable of retrieving an underwater vehicle 2. By means of a rope 50, the underwater vehicle 2 is pulled onto a retrieval ramp 12 of the system 1. A wave compensation ramp 24 is mounted on this retrieval ramp 12 in such a way that the wave compensation ramp 24 can move up and down about a horizontal pivot axis S relative to the retrieval ramp 12. The front end 26 of the wave compensation ramp 24 is connected to the retrieval ramp 12 via a joint 28. Mounted close to its free end 34 are two floating bodies 36, 38, cf. FIG. 1 and FIG. 4. The rear floating body 38 is mounted on a recovery device 40 for the underwater vehicle 2, cf. FIG. 4. The underwater vehicle 2 travels between two spread-apart guide strips 130, 132 toward the retrieval ramp 12, cf. FIG. 7, and is retained between the guide strips 130 and 132, cf. FIG. 8. The system 1 can be collapsed, cf. FIG. 3.

DE 39 38 188 A1 describes an apparatus and a method for hauling a boat 10 up into a stowage space 12 of a ship 11. A corresponding recovery apparatus 13 supports the boat 10 with the aid of a plurality of rollers 14. Two parallel roller chains 16 are driven by a drive 15 and move the boat 10 forward while it is being hauled up, cf. FIG. 1. The roller chains 16 are oriented parallel to the longitudinal axis of the stowage space 12 in the region of the floor 17 and are guided in plastics tracks above and below sprockets 161 and 162. Two parts 181 and 182 of a connecting means provide a releasable coupling between the roller chains 16 and the boat 10. The connecting means part 181 is a latching lug on the boat 10, the other connecting means part 182 is connected to the roller chains 16 via a carriage 19.

Thus a need exists for a recovery apparatus 26 and a recovery method, which reduce the risk of a large quantity of water being able to penetrate into the recovery apparatus.

Figure 1:
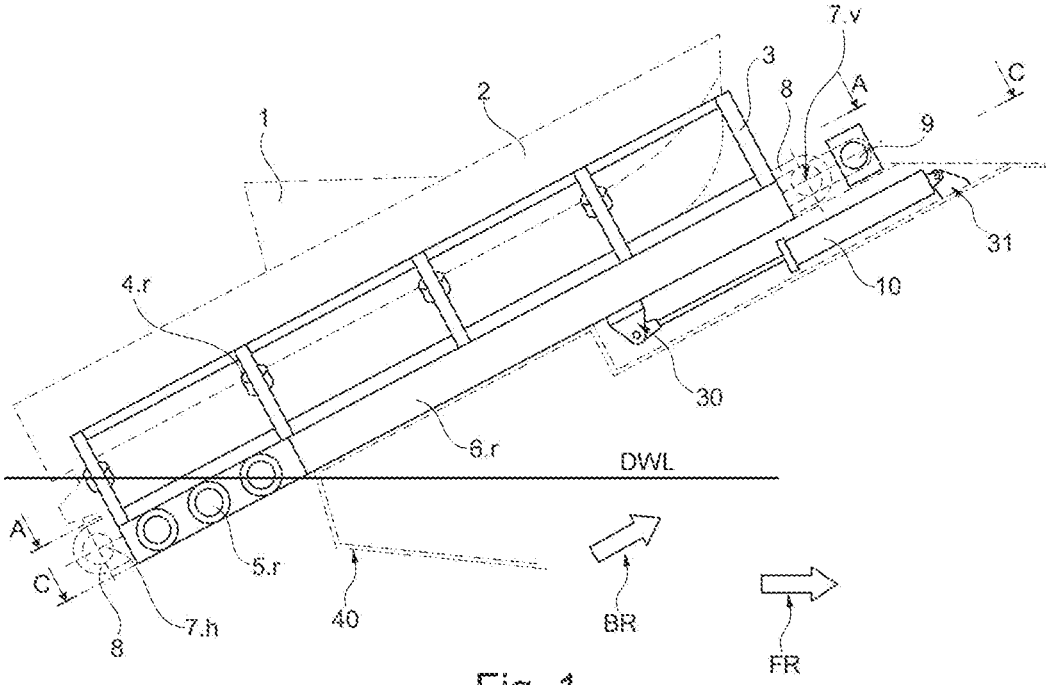
FIG. 1 is a side view of a first embodiment of the recovery apparatus with the frame in the recovering position.

Figure is a plan view of the movable frame of the first embodiment with a chain and without the watercraft (section A-A in FIG. 1).

Figure 2:
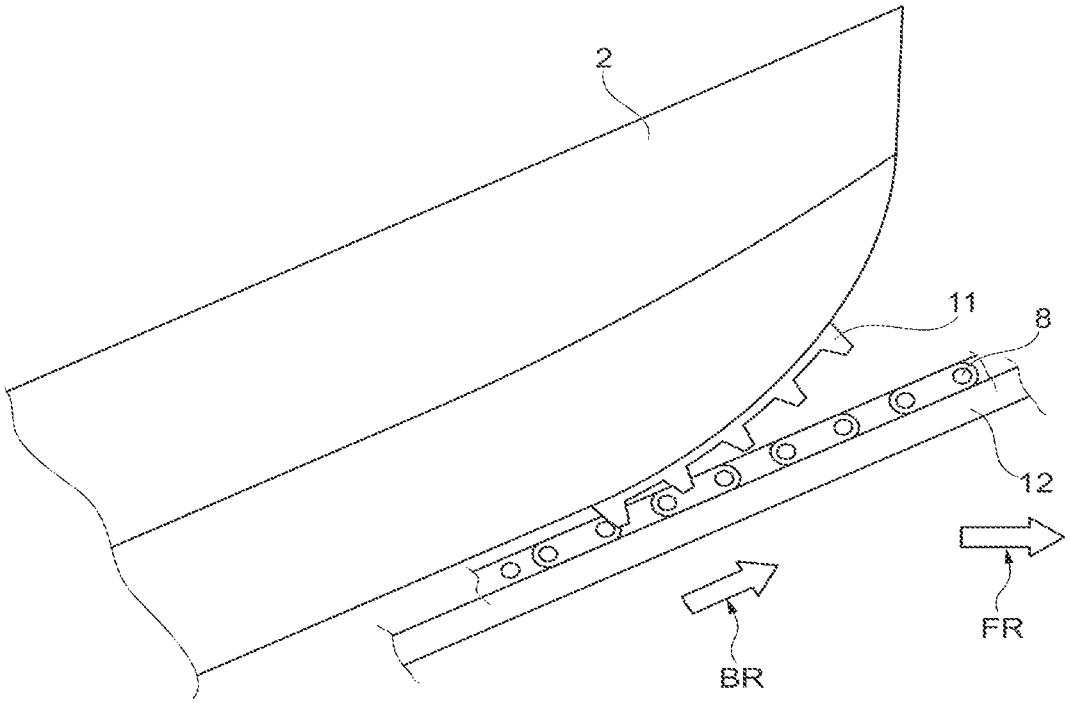
FIG. 2 is a front segment of a watercraft to be recovered, which is connected temporarily to a chain of the recovery apparatus by means of a plurality of gripping teeth.
Figure 3:
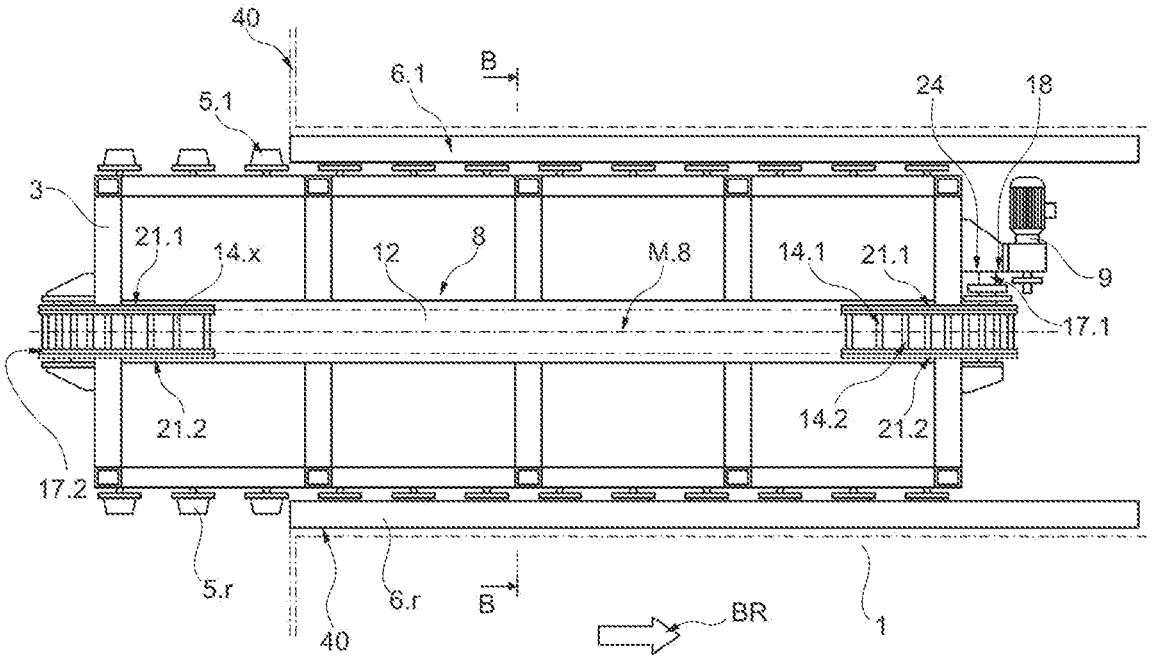
Figure 4:
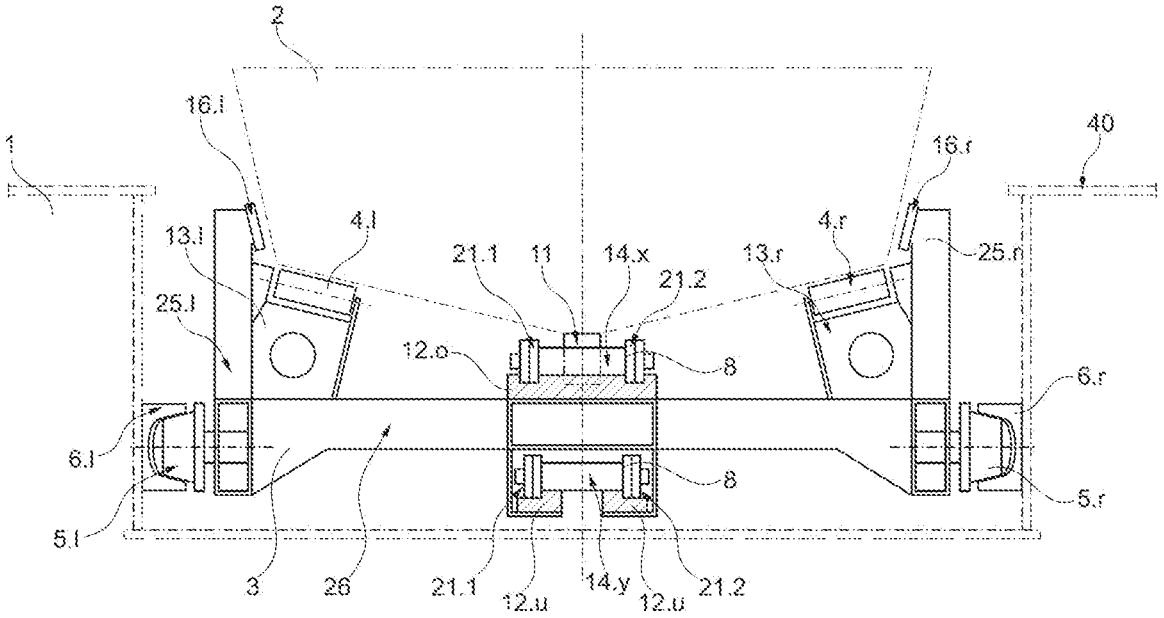

FIG. 4 is a cross-sectional view in the plane B-B through the frame in FIG. 3 with the watercraft in FIG. 2.

Figure 5:
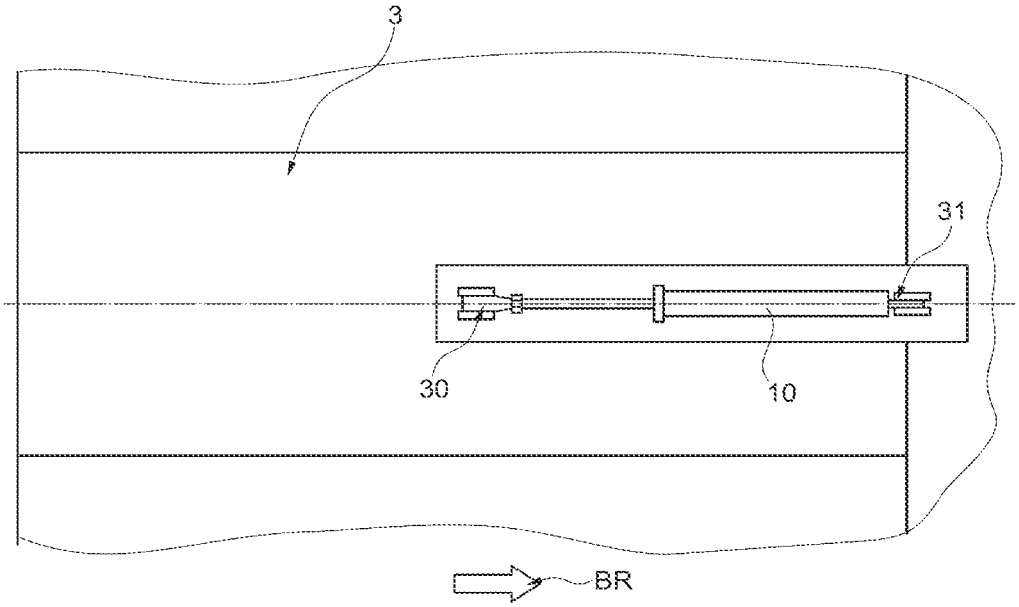

FIG. 5 is a plan view of the actuator for the frame in the plane C-C in FIG. 1.

Figure 6:
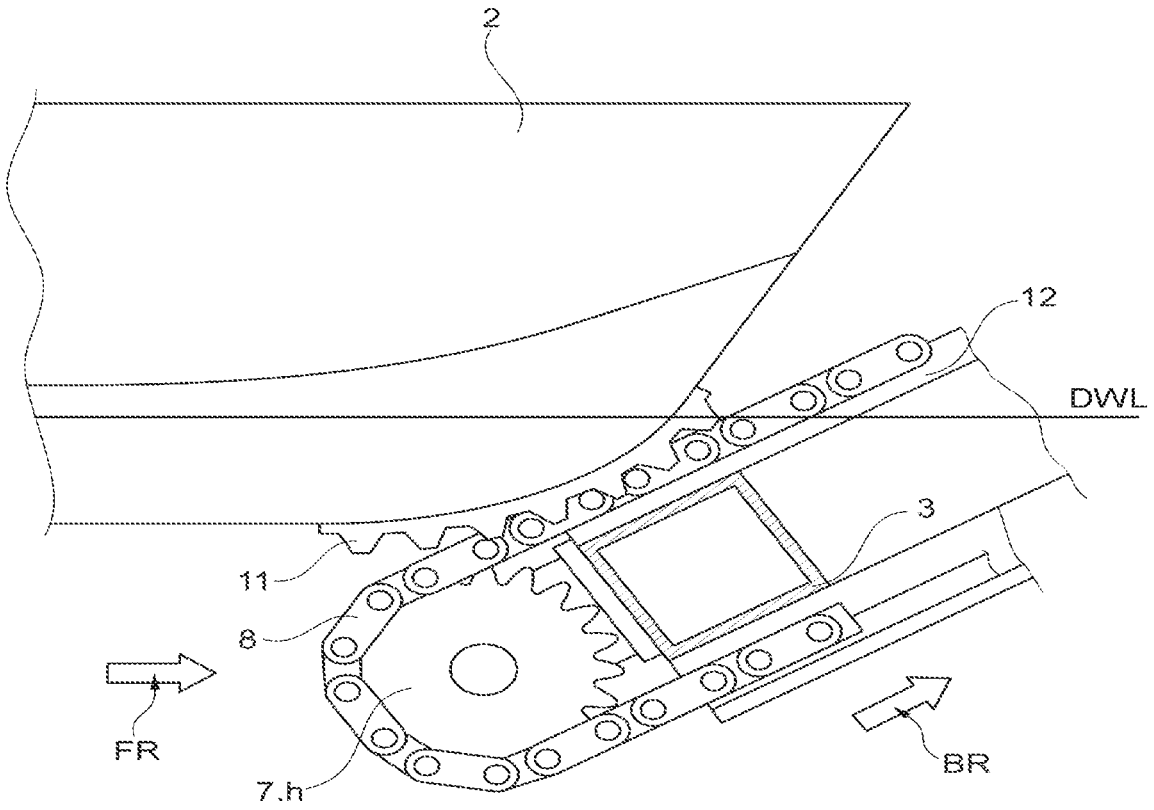

FIG. 6 is a detail view of a front segment of the watercraft and of a rear segment of the chain in FIG. 2.

Figure 7:
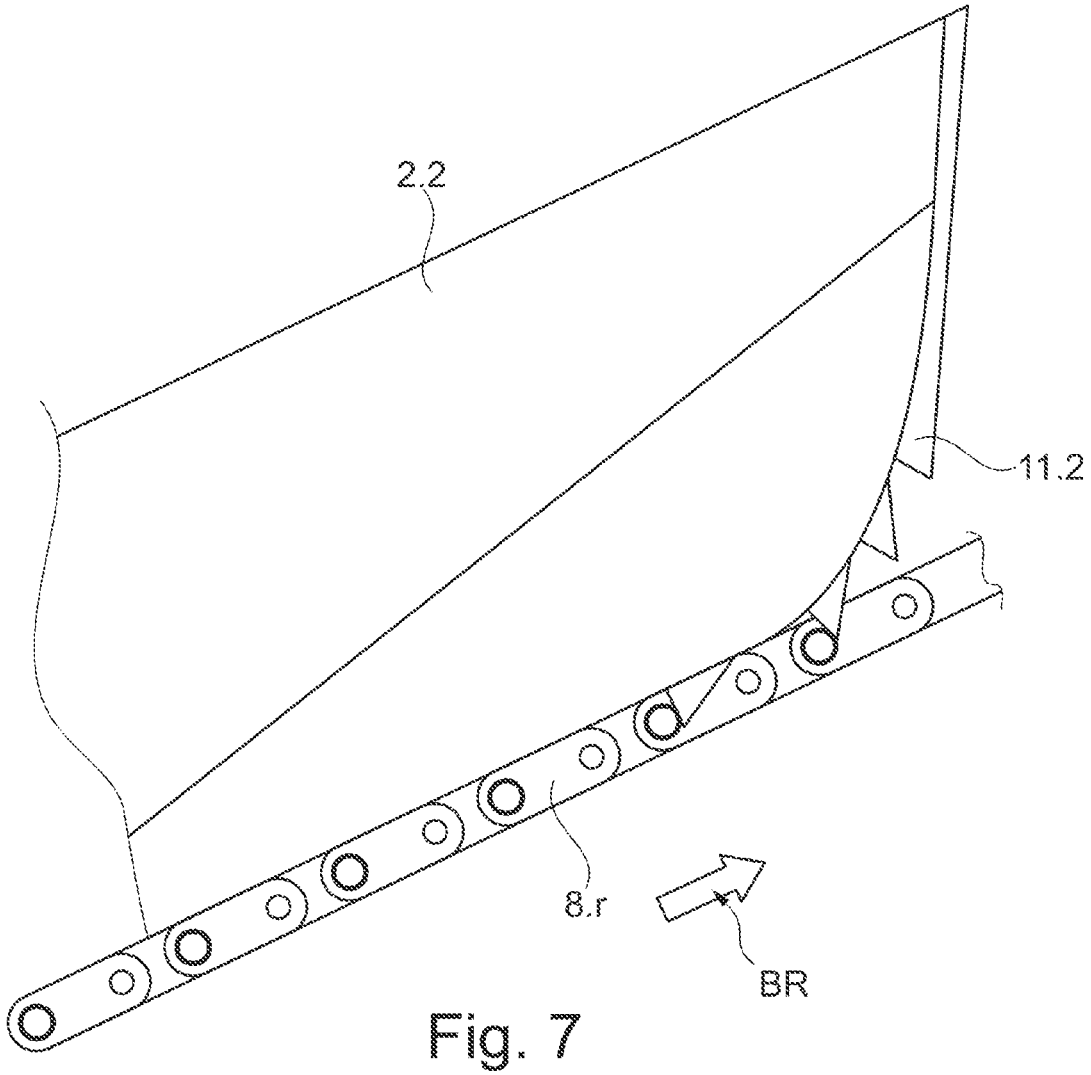

FIG. 7 is a front segment of a further watercraft to be recovered (second embodiment), which is connected temporarily to a further chain of the recovery apparatus by means of further gripping teeth.

Figure 8:
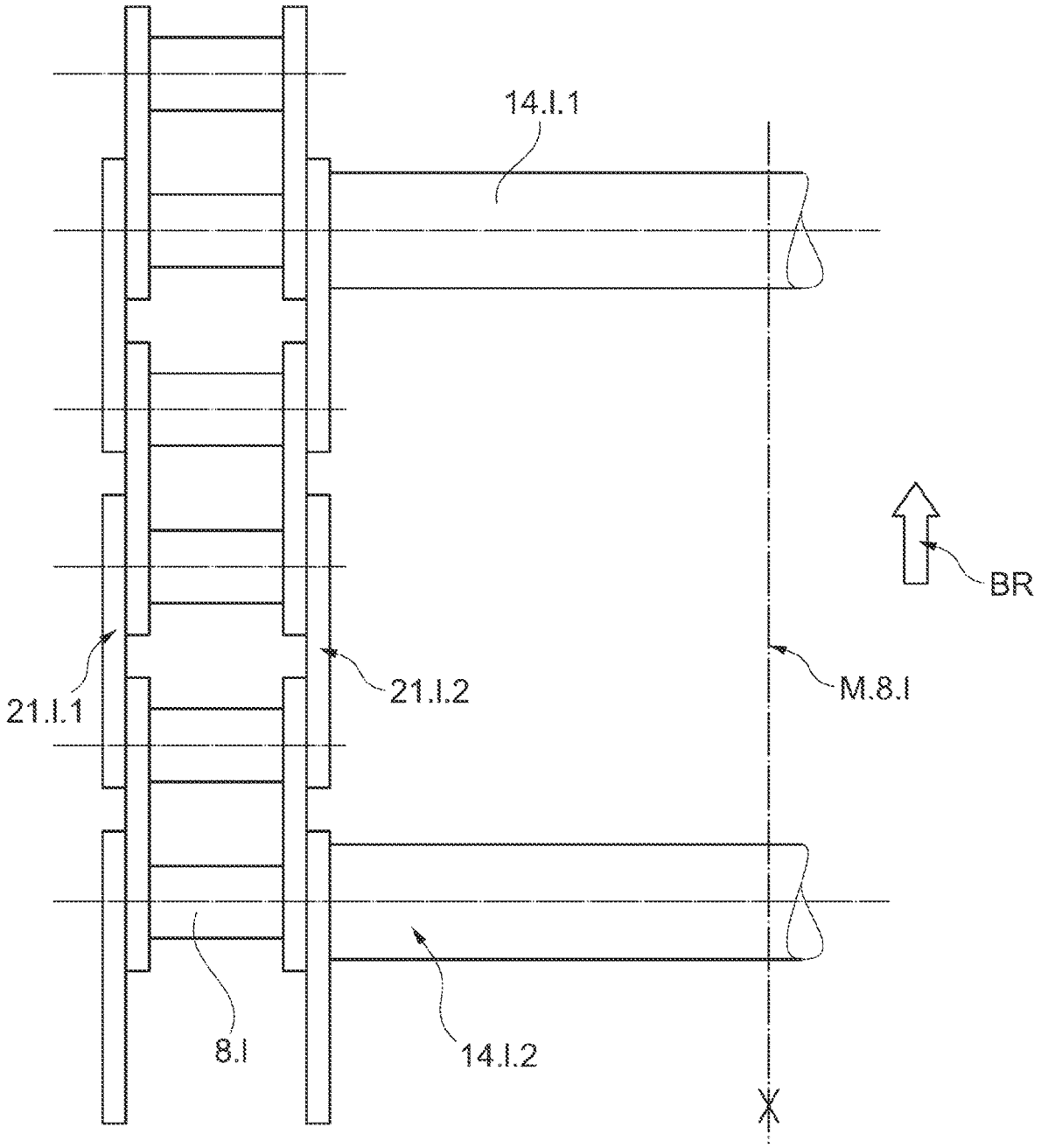

FIG. 8 is a plan view of the left-hand chain in FIG. 7.

Figure 9:
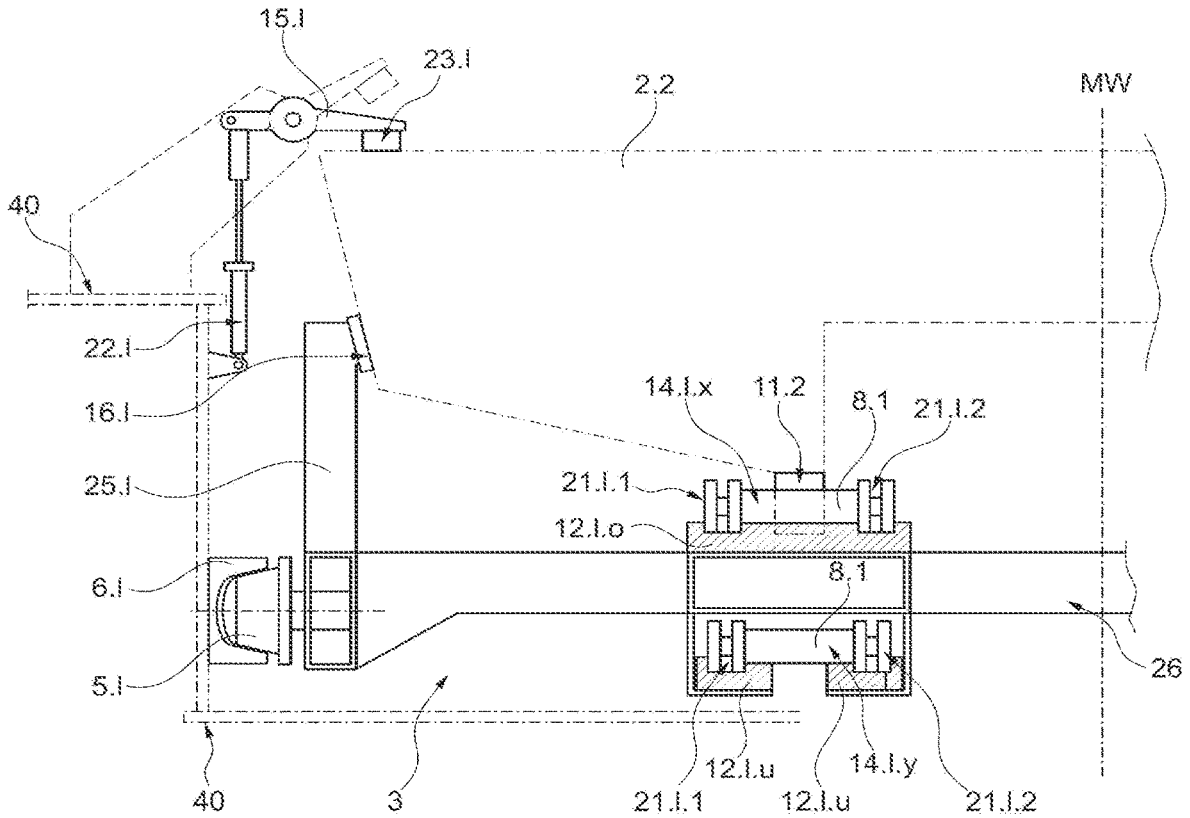

FIG. 9 is a cross-sectional view (half section) through the frame of the second embodiment with two chains, wherein one chain and the left-hand half of the watercraft in FIG. 7 are shown.

Figure 10:
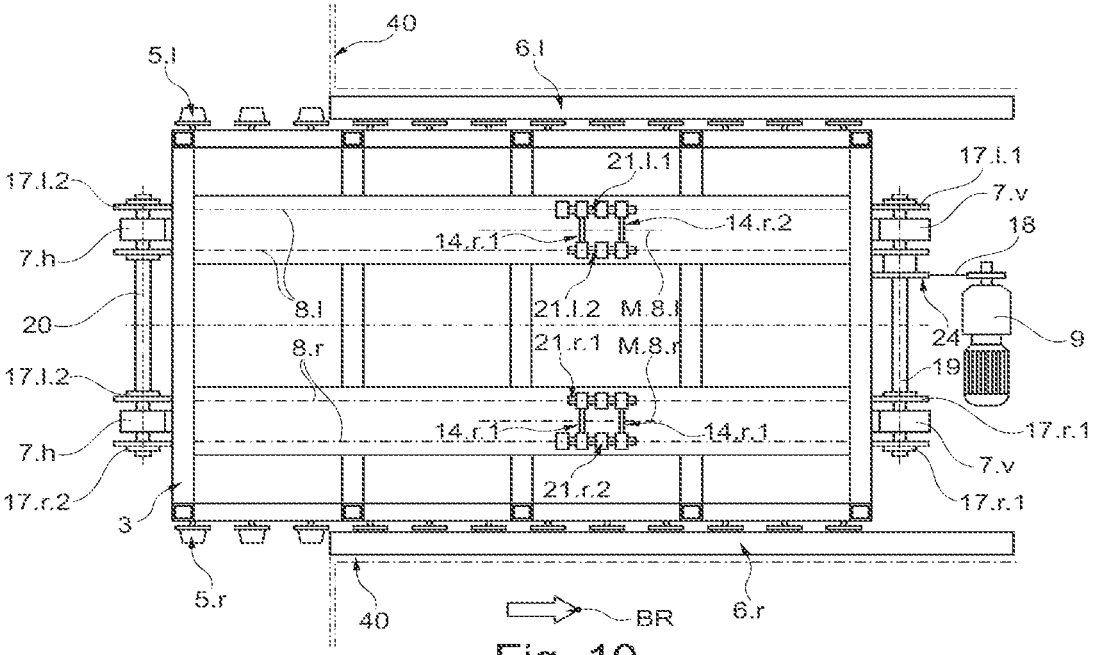

FIG. 10 is a plan view of the frame with two chains without the further watercraft.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a recovery apparatus and to a recovery method for recovering at least one watercraft using a chain, in particular for recovering a boat on board a mother ship.

The recovery apparatus according to the solution is capable of pulling at least one watercraft out of the water and recovering same. The recovery apparatus according to the solution comprises a carrying structure,
a frame,
a frame actuator,
at least one endless chain and
a chain drive.

The recovery method according to the solution is carried out with the aid of such a recovery apparatus.

The frame is held by the carrying structure and can be moved back and forth relative to the carrying structure between a recovering position and at least one parked position. The frame is capable of carrying a watercraft to be recovered. The frame actuator is capable of moving the frame together with a watercraft carried by the frame relative to the carrying structure from the recovering position into the or a parked position and as a result of pulling the carried watercraft out of the water.

The or each chain of the recovery apparatus comprises in each case a sequence of drivers and is mechanically connected to the frame. The or each chain can be moved relative to the frame along a closed curve in each case. The chain drive is capable of moving the or each chain relative to the frame and as a result along the closed curve. A watercraft floating on the water can be connected temporarily to the or at least one chain of the recovery apparatus. At least one driver of the chain moved by the chain drive pulls the temporarily connected watercraft out of the water and onto the frame.

When the frame is in the recovering position, at least a part of the or each chain of the recovery apparatus is located under the water surface. A watercraft to be recovered is pulled out of the water by the movement of the frame out of the recovering position into the or a parked position and by the movement of the chain relative to the frame.

By virtue of the or at least one driven chain having drivers, the recovery apparatus is capable of pulling not only a driven watercraft but also a nondriven watercraft out of the water, after the watercraft has been temporarily connected to the or at least one chain. In the case of a driven watercraft, the drive of the watercraft does not need to contribute at all or only needs to contribute in a supporting manner to pulling the watercraft onto the frame. The movement of the watercraft out of the water in particular does not depend on whether a propeller or a waterjet propulsion or some other constituent of the drive of the watercraft is located beneath or above the water surface and therefore can or cannot contribute to the propulsion of the watercraft. In particular, the or at least one driven chain having drivers avoids the need to recover the watercraft in two steps, namely in a first step, in which the drive of the watercraft contributes to recovery or the floating watercraft is pushed or pulled, and a second step, in which the drive of the watercraft no longer reaches into the water and therefore can no longer move the watercraft or the watercraft is no longer pushed or pulled. It is possible, but, by virtue of the invention, not necessary, for the watercraft to be connected to a rope with the aid of a hook or an eye and for the watercraft to be pulled onto the carrying structure by way of this rope. Furthermore, the chain of the recovery apparatus according to the solution prevents a watercraft temporarily connected to the chain from slipping back into the water from the frame.

In order to use the invention, a watercraft to be recovered needs to be adapted only relatively little to the recovery apparatus according to the solution. It is sufficient to mount at least one protrusion, for example a hook or a nose or a toothed rail, on the hull of the watercraft to be recovered, in a position close to the bow or close to the stern. The or at least one driver of the recovery apparatus engages behind the or a protrusion on the hull of the watercraft. Or the or at least one protrusion on the watercraft engages between two drivers. In both configurations, the watercraft is connected temporarily and releasably to the or at least one chain. The driven chain pulls the temporarily connected watercraft having the protrusion out of the water by way of at least one driver.

In order that a floating watercraft to be recovered can pass onto the frame held by the carrying structure, it is necessary for at least a part of the frame and/or a part of the or a chain to be located beneath the water surface. The frame can be moved back and forth between the recovering position and the or a parked position. Therefore, the frame is configured as a slide. The frame carries the or each chain and thus a watercraft to be recovered that is temporarily connected to a driver of the or a chain. Because the frame is movable relative to the carrying structure, it is not necessary for the frame or the carrying structure to be located permanently in a position in which a watercraft floating on the water can pass into a position above the frame. The movable configuration of the frame makes it possible for the frame and/or the chain for recovering the watercraft to be moved into a recovering position partially beneath the water surface and then for the frame together with the chain and the watercraft to be pulled into the or a parked position, in which the frame, the or each chain and the watercraft are located entirely above the water surface. The frame is thus located partially beneath the water surface only when a watercraft needs to be recovered. The configuration in which the frame can be pulled entirely out of the water and is located in the or a parked position entirely above the water surface reduces the risk of a large amount of water penetrating into the recovery apparatus. This risk should be reduced in particular when the recovery apparatus belongs to a further watercraft that recovers the watercraft while the further watercraft is floating on the water. A large quantity of penetrated water can compromise the stability of the further watercraft.

By virtue of the invention, a watercraft to be recovered can be pulled out of the water by superposition of two movements oriented in the same direction:

- a movement of the frame together with the or each chain and the watercraft relative to the carrying structure, and
- a movement of the or a chain relative to the frame, with the result that the watercraft is moved relative to the frame out of the water.

It is possible to execute the two movements in a temporally overlapping manner. This superposition of two movements saves time compared with serial execution or a configuration with a single relative movement. By virtue of the temporally overlapping execution, the watercraft is pulled out of the water more quickly. By virtue of the chain, the frame can be configured in a shorter manner—compared with a conceivable configuration of the frame without a chain. The extent of the frame in the direction of movement in which a watercraft is pulled out of the water only needs to be large enough for the frame to be able to securely hold a watercraft to be recovered. The extent of the frame can be less than the length of the watercraft. By virtue of the chain, the distance over which the frame is moved when it is moved from the recovering position into the parked position can be shorter compared with a conceivable configuration of the frame without a chain.

By virtue of the recovery apparatus according to the solution and of the recovery method according to the solution, a watercraft can be pulled out of the water into the or a parked position with little deployment of personnel or even in a fully automatic manner. It is sufficient for a watercraft to be recovered to travel in a central orientation toward the frame and for the frame to be located in the recovering position. All further steps in the recovery of the watercraft can proceed automatically. Therefore, the invention can also be used for recovering an unmanned watercraft. If the recovery apparatus is mounted on board a further watercraft, by virtue of the invention, it is not necessary for a crew member of the further watercraft to go to the recovery apparatus in order to pull the watercraft out of the water.

Preferably, the frame of the recovery apparatus is arranged in an obliquely rising manner relative to the carrying structure—as seen in the direction in which the frame actuator moves the frame into the parked position and the recovery apparatus pulls a watercraft out of the water. During this positioning of the frame, less force is required in order to pull the frame together with a watercraft to be recovered out of the recovering position into the or a parked position—compared with a vertical movement or a movement along a curved path. Preferably, the frame can be moved back and forth between the recovering position and the parked position by way of a purely linear movement in translation.

The frame in the recovering position is located partially beneath the water surface in order that a watercraft to be recovered can travel into a position above the frame in the recovering position and in order that at least one driver of the recovery apparatus can take hold of the watercraft from below. In one configuration, the frame in the or a parked position is located entirely above the water surface. This configuration reduces the risk of the frame being damaged by the water or by an object floating in the water, and reduces in particular the risk of corrosion or undesired fouling on the frame. In a preferred configuration, not only the frame but also a watercraft to be recovered that is on the frame are located entirely above the water surface when the frame is located in the or a parked position. This configuration reduces the risk of the watercraft being damaged by the water or an object in the water.

Preferably, the or each moved chain moves a watercraft to be recovered, which is connected temporarily to the chain, into the parked position in a direction parallel to the direction of movement of the frame. The movements of the frame and of the chain are thus executed parallel to one another. Further configurations are possible, for example wherein the or a chain moves the watercraft obliquely to the direction of movement of the frame.

In one configuration, the or at least one chain comprises two individual part-chains, between which a sequence of connecting elements, for example rollers or bars or cross-pieces, is mounted. These connecting elements act as the drivers. This configuration with two connected part-chains allows a particularly robust construction of the chain.

In one configuration, the recovery apparatus comprises a first endless driven chain having a sequence of drivers, and a further endless driven chain, which comprises a further sequence of drivers. The two chains are—as seen in the direction of movement of the frame from the recovering position into the parked position—attached to the frame alongside one another. Thus, the recovery apparatus comprises a left-hand chain and a right-hand chain. Preferably, in each case one driver of the left-hand chain and one driver of the right-hand chain—as seen in the direction of movement of the frame—are arranged at the same height. By virtue of this configuration, the same recovery apparatus is capable of selectively recovering a watercraft with one hull or with two hulls arranged alongside one another, for example a catamaran, or two sufficiently narrow watercraft alongside one another at the same time. In the case of a watercraft to be recovered having two hulls, the two chains prevent the watercraft from being pulled with a lateral offset or in such a way that the longitudinal axis of the watercraft is arranged obliquely to the direction of movement of the frame, resulting in the watercraft passing into an undesired oblique position relative to the frame. This undesired oblique position is prevented even more reliably when in each case two drivers are arranged at the same height.

A watercraft to be recovered is located above the or at least one chain and is pulled upward by at least one driver of the moved chain. In a first phase of this movement, the watercraft to be recovered is still floating on the water. Preferably, a holding apparatus of the recovery apparatus prevents the watercraft still floating on the water from moving upward relative to the chain and as a result losing contact with the drivers and slipping down again or to the side. This holding apparatus can be moved back and forth between a holding position and a releasing position. If the recovery apparatus is mounted on board a further watercraft, the holding apparatus also prevents the recovered watercraft from slipping down from the frame in the parked position on account of movements of the further watercraft.

In one configuration, the holding apparatus in the holding position pushes a watercraft to be recovered onto the frame. In one embodiment, the holding apparatus is fastened to the carrying structure or to the frame. The holding apparatus in the holding position holds the watercraft and nevertheless makes it possible for a watercraft pulled by the driven chain to be able to move relative to the frame and to be held by the holding apparatus during the movement. Preferably, at least one running roller is mounted on the holding apparatus and comes into contact with the watercraft when the holding apparatus is in the holding position.

Preferably, a guide device guides the frame during a movement from the recovering position into the or a parked position. In one configuration, the guided frame is capable of executing only a linear movement from the recovering position into the parked position, and the guide device prevents any lateral or oblique movement of the frame, even when the recovery apparatus is mounted on board a further watercraft that can be exposed to wave movements while it recovers the watercraft. Furthermore, the guide device limits preferably the linear movement of the frame in the direction of movement and in the opposite direction. The guide device can comprise for example at least one sequence of running rollers, which are mounted in a rail, for example a U profile, and can roll along the rail. In one embodiment, the guide device comprises two sequences of running rollers and two rails. The or each sequence of running rollers can be mounted on the frame and the or each rail can be mounted on the carrying structure. The or each rail is preferably delimited upwardly and downwardly by in each case two stop elements, which limit the possible upward and downward movement of the frame relative to the carrying structure.

Preferably, a directing unit of the recovery apparatus guides a watercraft to be recovered along the frame, while the or at least one chain pulls the watercraft along the frame. This configuration further reduces the risk of the watercraft—as seen in the direction of movement of the frame—tipping over to one side. This directing unit for the watercraft can consist of exclusively passive components, for example of running rollers.

Preferably, the frame executes a linear movement when it is moved from the recovering position into the parked position. Further forms of movement are likewise possible, for example rotation about a horizontal axis that is perpendicular to the longitudinal axis of a watercraft to be recovered and thus transverse to the direction of travel of the watercraft. The guide device for the frame can in this case comprise a parallelogram guide.

In one configuration, a sensor automatically detects the event of the frame reaching the parked position or a watercraft to be recovered that is on the frame reaching a stowed position. The sensor can comprise a light barrier, a proximity sensor, a contact sensor and/or a camera and an image evaluation unit. The event of the frame reaching the parked position or the watercraft reaching the stowed position triggers the step in which the chain drive is stopped. In one configuration, the chain drive is automatically stopped, and in another configuration, it is stopped manually.

The recovery apparatus according to the solution is capable of pulling a watercraft out of the water. In one configuration, the recovery apparatus is capable of actively launching a recovered watercraft again. For this purpose, the frame is moved out of the parked position into the recovering position, wherein the watercraft is still located on the frame and at least one driver of the recovery apparatus temporarily holds the watercraft. The or each chain is moved in the opposite direction relative to the frame. Or gravity moves the watercraft to the water, and the or each chain can rotate freely. The watercraft slides down or is moved down and floats on the water.

Preferably, at least one protrusion is mounted on the outer hull of a watercraft to be recovered, specifically such that this or at least one protrusion is located under water when the watercraft is floating on the water. A driver of the or a chain of the recovery apparatus comes into contact with the or a protrusion of the watercraft when the frame is in the recovering position and the watercraft travels toward the chain. When the chain is moved, the driver pulls the watercraft out of the water by way of the protrusion. Preferably, the frame with the chain is arranged obliquely relative to the carrying structure. Because the endless chain on the frame reaches obliquely into the water, the driver catches the watercraft at the protrusion regardless of the draft of the watercraft. This configuration saves on the need to pull the watercraft out of the water by means of a rope or an eye or even a crane.

The recovery apparatus can be mounted on board a further and preferably driven watercraft, for example a mother ship, a floating platform, or on land. The watercraft to be recovered can be a surface vessel or an underwater vehicle and have its own drive or no drive. In particular, the watercraft to be recovered can be an unmanned surface vessel or underwater vehicle, known as a drone, which is remote-controlled or autonomously controlled.

In the exemplary embodiment, the invention is used in order to pull a manned or unmanned boat, for example a floating drone, out of the water and to move it on board a mother ship 1 and to hold it in a stowed position there. Preferably, the boat has its own drive. The mother ship 1 likewise has its own drive and travels over water in a direction of travel FR (from left to right in FIG. 1) and is capable of recovering the boat while traveling. The recovery apparatus of the exemplary embodiment is mounted on board the mother ship 1. The carrying structure of the mother ship 1 forms the carrying structure of the recovery apparatus according to the solution in the exemplary embodiment.

The invention can equally also be used in order to pull the boat out of the water onto land. The recovery apparatus is then mounted on land and on the shore.

In the following text, two embodiments of the recovery apparatus according to the solution are described, which are used for in each case one type of boat to be recovered. The first embodiment is used in order to pull a boat 2 with a single hull out of the water, and the second embodiment is used for a boat 2.2 with two hulls, for example for a catamaran. FIG. 1 to FIG. 4 and FIG. 6 relate to the first embodiment (boat 2 with a single hull), FIG. 7 to FIG. 10 relate to the second embodiment (boat 2.2 with two hulls), and FIG. 5 relates to both embodiments.

The boat 2, 2.2 travels toward the mother ship 1 from the rear in the direction of travel FR until it arrives in a region above the recovery apparatus, and is then recovered by the recovery apparatus, as will be described further below. The designations "left" and "right" and "front" and "rear" relate to the common direction of travel FR of the mother ship 1 and of the boat 2, 2.2.

The boat 2 of the first embodiment has a single sequence of protrusions in the form of gripping teeth 11, which together form a toothed chain, or hooks or noses, wherein the protrusions are mounted centrally on the single hull of the boat 2 and are distributed over a lower part of the bow and a front part of the keel, cf. FIG. 2 and FIG. 6. Preferably, the gripping teeth 11 are fastened releasably to the hull, such that the gripping teeth 11 can be easily replaced and repaired in the event of wear or breakage. Preferably, the gripping teeth 11 are manufactured from stainless steel, although other materials are also possible.

In a corresponding manner, two sequences of protrusions, for example gripping teeth 11.2, are mounted on the two hulls of the boat 2.2 of the second embodiment, cf. FIG. 7. A gripping tooth of the left-hand sequence is arranged next to a gripping tooth of the right-hand sequence. The distances between in each case two successive gripping teeth 11.2 of the boat 2.2 are greater than the distances between the gripping teeth 11 of a sequence on the hull of the boat 2. The reason for this is explained further below.

The recovery apparatus of the exemplary embodiment comprises the following essential constituents:

- a frame 3 in the form of a basic framework, which is mounted obliquely on the carrying structure 40 and is linearly movable relative to the carrying structure 40,
- a chain in the form of a centrally attached double-roller conveyor chain 8 (first embodiment) or two chains in the form of a left-hand double-roller conveyor chain **8.*l* and a right-hand double-roller conveyor chain 8.*r*** (second embodiment),
- a sequence of drivers 14.1, 14.2, . . . (first embodiment) or a left-hand sequence of drivers **14.*l*.1, 14.*l*.2, . . . and a right-hand sequence of drivers 14.*r*.1, 14.*r*.2**, . . . (second embodiment),
- a chain drive for the or each chain 8, **8.*l*, 8.*r***, and
- a frame actuator 10 for the frame 3.

The frame 3 is—as seen in the direction of travel FR of the mother ship 1—arranged in an obliquely rising plane in the carrying structure 40 and can be moved linearly back and forth relative to the carrying structure 40 between a recovering position and at least one parked position. FIG. 1 shows a rear part of the carrying structure 40 and of the frame 3 in the recovering position. The or each chain 8, **8.*l*, 8.*r* is fastened in a movable manner to the frame 3 and is carried along during a movement of the frame 3. The frame 3 can be moved relative to the carrying structure 40 in an obliquely rising direction of movement BR from the recovering position into the or a parked position. In the recovering position, a rear part of the frame 3 and of the or each chain 8, 8.*l*, 8.*r* is located under the design waterline DWL and a front segment of a boat 2, 2.2 to be recovered can arrive in a position above the chain 8, 8**.*l*, 8.*r*. In the parked position, the frame 3 and the or each chain 8, 8.*l*, 8.*r* and also a recovered boat 2, 2.2 are located entirely above the design waterline DWL.

As can be seen in FIG. 1, the length of the frame 3, that is to say the extent in the direction of movement BR, can be less than the length of a boat 2, 2.2 to be recovered. Nevertheless, the frame 3 securely holds the boat 2, 2.2. The frame 3 of the exemplary embodiment has a U-shaped cross section with a sequence of a plurality of horizontal crossmembers and a left-hand sequence 25.*l* and a right-hand sequence 25.*r* of lateral and approximately perpendicular carriers, cf. FIG. 4 and FIG. 9. The horizontal crossmembers form a horizontal platform 26 of the frame 3.

In one configuration, a sensor arrangement automatically senses the event of the boat 2, 2.2 temporarily being connected to the chain 8, 8.*l*, 8.*r*. For example, a sensor on a chain 8, 8.*l*, 8.*r* senses that a gripping tooth 11, 11.2 is in contact with a driver 14.1, 14.2, . . . , 14.*l*.1, 14.*l*.2, . . . , 14.*r*.1, 14.*r*.2, . . . of the chain 8, 8.*l*, 8.*r*. Or a sensor senses the position of the boat 2, 2.2 relative to the frame 3 in a sensor direction parallel to the direction of travel FR or to the direction of movement BR, in order to sense the lateral offset of the boat 2, 2.2 relative to the frame 3. A further sensor senses the position of the boat 2, 2.2 relative to the frame 3 in a sensor direction perpendicular to the direction of travel FR and perpendicular to the direction of movement BR, in order to identify whether the boat 2, 2.2 has reached a chain 8, 8.*l*, 8.*r*. Rather than a sensor, it is also possible for a person on board the mother ship 1 to sense this event.

A guide device guides the frame 3 during a movement from the recovering position into the parked position and during a movement in the opposite direction. The guide device of the exemplary embodiment includes a left-hand sequence 5.*l* of running rollers and a right-hand sequence 5.*r* of further running rollers, wherein the running rollers 5.*l*, 5.*r* are fastened to the frame 3 and can rotate relative to the frame 3 in each case about a horizontal axis of rotation that is perpendicular to the direction of movement BR. Preferably, the running rollers 5.*l*, 5.*r* are manufactured from hard plastic, provided with a settable eccentric axis and can be easily removed and replaced. The side view in FIG. 1 shows the right-hand sequence 5.*r*, and the plan views in FIG. 3 and FIG. 10 show both sequences 5.*l* and 5.*r*. The guide device also includes two rails 6.*l* and 6.*r* in the form of U profiles, which both face the frame 3, cf. FIG. 4 and FIG. 9, are preferably manufactured from steel and are fastened to the carrying structure 40. The left-hand sequence 5.*l* of running rollers is held in a rotatable manner in the left-hand rail 6.1, and the right-hand sequence 5.*r* is held in a rotatable manner in the right-hand rail 6.*r*.

The centrally attached double-roller conveyor chain 8 of the first embodiment comprises two endless part-chains 21.1 and 21.2, which are arranged alongside one another. Each part-chain 21.1, 21.2 comprises in each case a sequence of chain links, which are connected together in an articulated manner. Mounted between the left-hand part-chain 21.1 and the right-hand part-chain 21.2 is a sequence of drivers in the form of pins or rollers 14.1, 14.2, . . . , cf. FIG. 3. The drivers 14.1, 14.2, . . . can preferably rotate relative to the two part-chains 21.1 and 21.2 about separate central axes. Each part-chain 21.1, 21.2 is guided around in each case two sprockets, cf. the plan view in FIG. 3. FIG. 3 shows the front sprocket pair 17.1 and the rear sprocket pair 17.2, which together hold and guide the two part-chains 21.1 and 21.2. The front sprocket pair 17.1 is mounted fixedly on a shaft and the rear sprocket pair 17.2 is mounted fixedly on a nondriven axle. FIG. 3 furthermore shows the centerline M.8 of the double-roller conveyor chain 8.

As can be seen in FIG. 4, the chain 8 runs around the horizontal platform 26 formed by the crossmembers. An upper segment of the chain 8 is located above this horizontal platform 26 and a lower segment is located beneath the platform 26. The lower segment of the centrally arranged chain 8 runs over a lower guide rail 12.*u*, which is fastened to the frame 3, is moved together with the frame 3 and is preferably manufactured from wear-resistant and low-friction plastic. In a corresponding manner, the upper segment runs over an upper guide rail 12.*o*, which is preferably constructed like the lower guide rail 12.*u*. The chain 8 contacts both guide rails 12.*o* and 12.*u* from above. Each guide rail 12.*o*, 12.*u* for the chain 8 is configured such that only little friction occurs between the chain 8 and the upper surface of the guide rail 12.*o*, 12.*u*. Furthermore, the guide rail 12.*o*, 12.*u* reduces the wear to the chain 8. The guide rail 12.*o*, 12.*u* can be exchanged and repaired more easily than the chain 8. FIG. 4 shows two upper single rails 12.*o* and two lower single rails 12.*u* for the two part-chains 21.1 and 21.2, which have been let into the guide rails 12.*o* and 12.*u*, respectively.

In a corresponding manner, the left-hand double-roller conveyor chain 8.*l* of the second embodiment comprises two left-hand endless part-chains 21.*l*.1 and 21.*l*.2, which are shown in FIG. 8 and each comprise a sequence of chain links. In the embodiment shown, at every fourth chain link, a respective driver 14.*l*.1, 14.*l*.2, . . . in the form of a pin is connected in a rotatable manner to the two part-chains 21.*l*.1, 21.*l*.2. The right-hand double-roller conveyor chain 8.*r* has a corresponding construction and comprises two right-hand part-chains 21.*r*.1 and 21.*r*.2.

In each case one driver 14.*l*.1, 14.*l*.2, . . . of the left-hand double-roller conveyor chain 8.*l* is—as seen in the direction of movement BR—arranged at the same height as a driver 14.*r*.1, 14.*r*.2, . . . of the right-hand double-roller conveyor chain 8.*r*. The distance between two successive drivers of the same double-roller conveyor chain 8.*l* or 8.*r* is large enough that the following is brought about: A boat 2.2 with two sequences, arranged alongside one another, of gripping teeth 11.2 travels centrally toward the frame 3, which is in the recovering position. A driver 14.*l*.1, 14.*l*.2, . . . of the left-hand double-roller conveyor chain 8.*l* comes into contact with a gripping tooth of the left-hand sequence and a driver 14.*r*.1, 14.*r*.2, . . . of the right-hand conveyor chain 8.*r* comes into contact with a gripping tooth of the right-hand sequence. It is possible for the direction of travel of the boat 2.2 toward the recovery apparatus not to coincide exactly with the direction of travel FR of the mother ship 1. Nevertheless, the two gripping teeth, arranged alongside one another, of two drivers that are arranged at the same height are caught. The distance between two gripping teeth of the same sequence and the distance between two drivers of the same chain 8.*l*, 8.*r* are sufficiently large. The synchronous movement of the chains 8.*l* and 8.*r* brings the boat 2.2 into a position in which the central axis thereof is arranged parallel to the direction of travel FR of the mother ship 1.

FIG. 9 shows a left-hand lower guide rail 12.*l*.*u* for the lower segment of the left-hand chain 8.*l* and a left-hand upper guide rail 12.*l*.*o* for the upper segment of the left-hand chain 8.*l*. The right-hand chain 8.*r* is guided in a corresponding manner by two right-hand guide rails 12.*r*.*u* and 12.*r*.*o*.

The plan view in FIG. 10 shows a left-hand front sprocket pair 17.*l*.1 and a left-hand rear sprocket pair 17.*l*.2 for the left-hand double-roller conveyor chain 8.*l* and the central axis M.8.*l* of the left-hand double-roller conveyor chain 8.*l*. The right-hand double-roller conveyor chain 8.*r* is guided about a right-hand front sprocket pair 17.*r*.1 and a right-hand rear sprocket pair 17.*r*.2. The two front sprocket pairs 17.*l*.1 and 17.*r*.1 are mounted fixedly on a driven shaft 19 and the two rear sprocket pairs 17.*l*.2 and 17.*r*.2 are mounted fixedly on a nondriven axle 20, cf. FIG. 10. The shaft 19 is fastened to the frame 3 in a rotatable manner in a front bearing 7.*v* and the axle 20 is fastened to the frame 3 in a rotatable manner in a rear bearing 7.*h*, cf. FIG. 10. Because the two front sprocket pairs 17.*l*.1 and 17.*l*.2 are mounted on the same shaft 19 and the two rear sprocket pairs 17.*l*.2 and 17.*r*.2 are mounted on the same axle 20, the four individual chains 21.*l*.1, 21.*l*.2, 21.*r*.1 and 21.*r*.2 are always moved synchronously and at the same speed.

In the plan views in FIG. 3 and FIG. 8, only segments of the chains 8, 8.*l*, 8.*r* are shown. FIG. 9 shows a left-hand upper guide rail 12.*l*.*o* with two single rails, which is fastened to the frame 3 and over which the upper segment of the left-hand double-roller conveyor chain 8.*l* runs. A corresponding right-hand upper guide rail 12.*r*.*o* is mounted on the frame 3 under the upper segment of the right-hand double-roller conveyor chain 8.*r*. The lower segments are guided in a corresponding manner.

The gripping teeth 11, 11.2 on the boat 2, 2.2 to be recovered and the chain 8, 8.*l*, 8.*r* having the drivers 14.1, 14.2, . . . , 14.*l*.1, 14.*l*.2, . . . , 14.*r*.1, 14.*r*.2, . . . are adapted to one another such that at least one gripping tooth 11, 11.2 can engage in the gap between two drivers 14.1, 14.2, . . . , 14.*l*.1, 14.*l*.2, . . . , 14.*r*.1, 14.*r*.2, . . . , cf. FIG. 2 and FIG. 6. In the second embodiment, two sequences of gripping teeth 11.2 are mounted on the two hulls of the boat 2.2, in each case one sequence on one hull. The distance between the two chains 8.*l* and 8.*r* is coordinated with the distance between the two sequences of gripping teeth 11.2. In one configuration (not shown), the distance between the two chains 8.*l* and 8.*r* can be changed and as a result coordinated with the distance between the two sequences of gripping teeth.

Each chain 8, 8.*l*, 8.*r* can be moved along a closed curve relative to the frame 3. During operation, the chain 8, 8.*l*, 8.*r* does not perform any other movement relative to the frame 3. A motor 9, preferably an electric motor, rotates the or each chain 8, 8.*l*, 8.*r* through the closed curve. Preferably, the motor 9 is capable of moving the or each chain 8, 8.*l*, 8.*r* selectively in a first direction or in an opposite second direction. When the or each chain 8, 8.*l*, 8.*r* is moved in the first direction, the upper segment of the chain 8, 8.*l*, 8.*r* is pulled in the direction of movement BR of the frame 3 and pulls a boat 2, 2.2 out of the water, when a gripping tooth 11, 11.2 of the boat 2, 2.2 is caught by a driver 14.1, 14.2, . . . , 14.*l*.1, 14.*l*.2, . . . , 14.*r*.1, 14.*r*.2, . . . of the or a chain 8, 8.*l*, 8.*r*. If the chain 8, 8.*l*, 8.*r* is moved in the opposite direction or can run in an unbraked manner, a boat 2, 2.2 can be moved to the water on the frame 3 and launched, wherein gravity slides the boat 2, 2.2 downward on the inclined frame 3.

The motor 9 moves the or each chain 8, 8.*l*, 8.*r* as follows: An output shaft of the motor 9 drives a drive sprocket. The drive sprocket moves a drive roller chain 18. The drive roller chain 18 rotates a driven sprocket 24, which is mounted fixedly on the shaft 19 and rotates the shaft 19. Further drive concepts are possible. For example, the motor 9 can be arranged in the interior of the shaft 19.

The or each chain 8, 8.*l*, 8.*r* pulls the boat 2, 2.2 in the direction of movement BR over the frame 3. FIG. 4 shows a left-hand sequence 4.*l* and a right-hand sequence 4.*r* of running rollers. Each running roller of the left-hand sequence 4.*l* is mounted on the frame 3 in a rotatable manner by means of a left-hand mount 13.*l* and each running roller of the right-hand sequence 4.*r* is mounted on the frame 3 in a rotatable manner by means of a right-hand mount 13.*r*. Preferably, the running rollers are manufactured from an elastic material, for example rubber, or from a low-wear plastic. The boat 2, 2.2 slides over the running rollers 4.*l* and 4.*r*. In one configuration, the distance between the mounts 13.*l* and 13.*r* and thus the distance between the sequences of running rollers 4.*l* and 4.*r* can be changed and thus adapted to the underwater profile of a boat 2, 2.2. In FIG. 9, the running rollers 4.*l* and 4.*r* have been omitted. By virtue of the mounts 13.*l*, 13.*r*, the boat 2, 2.2 can comprise a keel and can nevertheless be held on the frame 3—the mount 13.*l*, 13.*r* ensures that there is a sufficient distance from the horizontal platform 26 and that the boat 2, 2.2 rests horizontally on the frame 3 and is not inclined to one side.

In one configuration, the mounts 13.*l* and 13.*r* can be extended and retracted again, such that the running rollers 4.*l* and 4.*r* can be moved obliquely or vertically up or down relative to the frame 3. As a result, the recovery apparatus can be adapted to the depth of a keel of the boat 2, 2.2 and to the underwater profile thereof.

Mounted on each of the two lateral carriers 25.*l*, 25.*r* of the frame 3 is a sequence 16.*l*, 16.*r* of guide elements, cf. FIG. 4 and FIG. 9. These guide elements 16.*l*, 16.*r* guide and support the boat 2, 2.2 on the frame 3 from two sides and nevertheless allow the guided boat 2, 2.2 to be pulled in the direction of movement BR relative to the frame 3. Each guide element 16.*l*, 16.*r* can comprise a running roller made for example of rubber. The guide elements 16.*l*, 16.*r* can also be configured as continuous plastics sliding profiles.

An actuator 10 is capable of moving the frame 3 together with the chain 8, 8.*l*, 8.*r* and a boat 2, 2.2 on the frame 3 from the recovering position into the or a parked position or vice versa. In the exemplary embodiment, the ramp actuator 10 is configured as a hydraulic or pneumatic piston-cylinder unit, which is arranged centrally beneath the frame 3 and in one configuration protrudes forward beyond the frame 3, cf. FIG. 1 and FIG. 5. The actuator 10 can also be configured as an electric adjusting motor. In the situation in FIG. 1, the cylinder of the ramp actuator 10 is fully extended. The front end of the piston-cylinder unit 10 is connected to the carrying structure 40 in an articulated manner by means of a front mechanical connecting element 31 and the rear end is connected to the frame 3 in an articulated manner by means of a rear mechanical connecting element 30. The travel that the cylinder of the ramp actuator 10 can execute limits the possible linear movement of the frame 3 relative to the carrying structure 40.

The boat 2, 2.2 is pulled out of the water with the aid of the chain 8, 8.*l*, 8.*r* and the movement of the frame 3 into the parked position and is itself brought into a stowed position on board the mother ship 1. In this stowed position, the boat 2, 2.2 is located preferably entirely in the interior of the mother ship 1 and does not protrude beyond the outer hull. It is possible to close a flap or a gate of the mother ship 1 and to protect the boat 2, 2.2 in the stowed position from environmental influences. This configuration reduces the electronic signature (the radar cross section) of the mother ship, i.e. the identifiability thereof in a radar image. The boat 2, 2.2 in the stowed position can also be positioned on an open deck of the mother ship 1.

In one configuration, the boat 2, 2.2 remains on the frame 3 as long as it remains on board the mother ship 1 in the stowed position, and at least one gripping tooth 11, 11.2 remains connected to a driver 14.1, 14.2, . . . , **14.*l*.1, 14.*l*.2, . . . , 14.*r*.1, 14.*r*.2, . . . . In one configuration, a sensor (not shown) senses the event of the frame 3 reaching the only possible parked position. The sensor can comprise a contact switch or a proximity switch or a light barrier. It is also possible for a camera to capture images of the boat 2, 2.2 on the frame 3 and for an image evaluation unit to evaluate these images and to automatically sense the event. The sensing of the event of the frame 3 reaching the parked position triggers the steps in which the ramp actuator 10 and the motor 9 for the chain 8, 8.*l*, 8.*r* are stopped. In a modification, the movements of the frame 3 and/or of the or each chain 8, 8.*l*, 8.*r* are stopped when the boat 2, 2.2 reaches a predetermined position relative to the carrying structure 40, for example the stern of the boat 2, 2.2 reaches a particular point of the frame 3. The parked position of the frame 3 can thus depend on the length of the boat 2, 2.2 and on the position of the boat 2, 2.2 on the frame 3. This configuration avoids the need to pull the boat 2, 2.2 out of the water further than necessary. The frame 3** is also only moved as far as necessary.

In one configuration, the ramp actuator 10 holds the frame 3 in the parked position and the motor 9 prevents the chain 8, **8.*l*, 8.*r* from rotating as long as the boat 2, 2.2 is intended to remain in the stowed position. In an alternative configuration, a locking unit holds the frame 3 in the parked position. Preferably, a spring element holds a locking body (not shown) in a locking position. As a result, the locking body holds the frame 3 in the parked position until an actuator (not shown) pulls the locking body counter to the spring force into a releasing position and the frame 3 can be moved again. This configuration further reduces the risk of the frame 3 with the boat 2, 2.2 sliding undesirably down from the parked position. In one configuration, this or another locking unit also locks the or each chain 8, 8.*l*, 8.*r***.

A rear part of the boat 2, 2.2 still floats on the water even when a gripping tooth 11, 11.2 is caught by a driver 14.1, 14.2, . . . , **14.*l*.1, 14.*l*.2, . . . , 14.*r*.1, 14.*r*.2, . . . and a chain 8, 8.*l*, 8.*r* pulls the boat 2, 2.2 out of the water. It is only shortly before the frame 3 reaches the parked position that the boat 2, 2.2 fully leaves the water. The boat 2, 2.2 is intended to maintain contact with the chain 8, 8.*l*, 8.*r* even in swell. Furthermore, the boat is intended to be held securely in the parked position of the frame 3 and be securely supported. Therefore, in the exemplary embodiment, a holding apparatus with a left-hand constituent 15.*l* and a corresponding right-hand constituent 15.*r* holds the boat 2, 2.2 on the frame 3 and in a position there in which the boat 2, 2.2 remains connected to the chain 8, 8.*l*, 8.*r*. FIG. 9 shows the left-hand constituent 15.*l*, which is omitted in FIG. 4. An actuator 22.*l* in the form of a piston-cylinder unit moves the left-hand constituent 15.*l* back and forth between a holding position (solid line) and a releasing position (dashed line). When the constituent 15.*l* is in the holding position, a contact element 23.*l* is in contact from above with the boat 2, 2.2 on the frame 3. In the releasing position, a distance arises between the left-hand constituent 15.*l* and the boat 2, 2.2 on the frame 3. In a corresponding manner, an actuator 22.*r* is capable of moving the right-hand constituent 15.*r***.

Various configurations are possible for how the holding apparatus **15.*l*, 15.*r* holds a boat 2, 2.2 on the frame 3. In one configuration, the constituents 15.*l*, 15.*r* are mounted fixedly on the carrying structure 40, and in another configuration they are mounted fixedly on the frame 3 and moved together with the frame 3**.

In one configuration, the contact element **23.*l*, 23.*r* is capable of holding the boat 2, 2.2 only when the boat 2, 2.2 has reached the stowed position. The contact element 23.*l*, 23.*r* is configured for example as a rubber buffer. In another configuration, the boat 2, 2.2 can move relative to the contact element 23.*l*, 23.*r* even when the contact element 23.*l*, 23.*r* is contact with the boat 2, 2.2 on the frame 3. Each contact element 23.*l*, 23.*r* comprises, in one configuration, a running roller that can rotate about an axis that is perpendicular to the direction of movement BR of the frame 3**. This axis of rotation can be permanently horizontal or be able to rotate about an axis parallel to the direction of movement BR and adapt to the upper edge of the boat hull.

In one configuration, the constituents **15.*l*, 15.*r* are moved into the holding position when the boat 2, 2.2 has reached its stowed position. The holding apparatus 15.*l*, 15.*r* can be mounted on the carrying structure 40, cf. FIG. 9, or on the frame 3. In another configuration, the holding apparatus 15.*l*, 15.*r* is already moved into the holding position while the boat 2, 2.2 is still being pulled out of the water by the chain 8, 8.*l*, 8.*r* and the movement of the frame 3. This configuration is expediently combined with the running rollers as contact elements 23.*l*, 23.*r***.

In one configuration, each holding apparatus actuator **22.*l*, 22.*r* exerts a pressure on the contact element 23.*l*, 23.*r* and acts as a spring element. Preferably, the pressure that the actuator 22.*l*, 22.*r* exerts on the boat 2, 2.2 on the frame 3 is measured, for example in that the hydraulic pressure in a fluid circuit for the actuators 22.*l*, 22.*r* is measured. The actuator 22.*l*, 22.*r* moves the constituent 15.*l*, 15.*r* toward the boat 2, 2.2 as long as the exerted pressure remains under a predetermined pressure limit, and then stops the movement of the constituent 15.*l*, 15.*r*. This ensures that the holding apparatus 15.*l*, 15.*r* does not damage the boat 2, 2.2. Nevertheless, the holding apparatus 15.*l*, 15.*r* can successively hold boats with different vertical dimensions on the frame 3**.

A boat 2, 2.2 is recovered as follows in the exemplary embodiment:

- The cylinder of the ramp actuator 10 is extended and moves the frame 3 from the or a parked position into the recovering position.
- The boat 2, 2.2 travels toward the mother ship 1 from the rear in a central orientation until the boat 2, 2.2 reaches the or a chain 8, **8.*l*, 8.*r***. This event is sensed preferably automatically.
- Now at the latest, the motor 9 starts to rotate and moves the or each chain 8, **8.*l*, 8.*r***.
- At least one gripping tooth 11, 11.2 per hull of the boat 2, 2.2 is caught from the rear by a driver 14.1, 14.2, . . . , **14.*l*.1, 14.*l*.2, . . . , 14.*r*.1, 14.*r*.2, . . . . The or each chain 8, 8.*l*, 8.*r* pulls the boat 2, 2.2 caught in this way onto the frame 3. The boat 2, 2.2 slides over the running rollers 4.*l*, 4.*r* and along the guide elements 16.*l*, 16.*r***.
- In one configuration, the constituents **15.*l*, 15.*r* of the holding apparatus are already now moved into the holding position and push the boat 2, 2.2 down onto the frame 3**.
- In a manner temporally overlapping with the operation of pulling the boat 2, 2.2 onto the frame 3, the cylinder of the ramp actuator 10 is retracted again. As a result, the frame 3 with the or each moved chain 8, **8.*l*, 8.*r* and the temporarily connected boat 2, 2.2 is pulled in the direction of movement BR from the recovering position into the or a parked position. The running rollers 5.*l*, 5.*r* on the frame 3 slide along the rails 6.*l*, 6.*r***.

As soon as the frame 3 has reached the or a parked position and/or the boat 2, 2.2 has been pulled fully out of the water and has reached its stowed position, the movement of the or each chain 8, 8.*l*, 8.*r* and the movement of the cylinder of the ramp actuator 10 are stopped.

In one configuration, the frame 3 and/or the chain 8, 8.*l*, 8.*r* are locked.

In one configuration, the constituents 15.*l*, 15.*r* of the holding apparatus are only now moved into the holding position.

In the exemplary embodiment, the boat 2, 2.2 remains on the frame 3 in the stowed position until it is intended to be launched again. For this purpose, the corresponding reverse steps are carried out. In one configuration, the motor 9 rotates the chain 8, 8.*l*, 8.*r* in the opposite direction, such that the chain 8, 8.*l*, 8.*r* pulls the boat 2, 2.2 into the water. In another configuration, gravity moves the boat 2, 2.2 from the inclined frame 3 into the water. It is possible for the motor 9 configured as an electric motor to act as a brake and generator when the boat 2, 2.2 slides onto the water.

REFERENCE SIGNS

1 Mother ship, carries the recovery apparatus of the exemplary embodiment

2 Watercraft to be recovered, having a hull and a plurality of gripping teeth 11 (first embodiment)

2.2 Watercraft to be recovered, having two hulls and a plurality of gripping teeth 11.2 on each hull (second embodiment)

Frame, linearly movable relative to the carrying structure 40 of the mother ship 1, comprises the horizontal platform 26 and the lateral carriers 25.*l*, 25.*r*

4.*l* Running rollers arranged on the left for guiding the watercraft 2, 2.2 relative to the frame 3, mounted on the left-hand mount 13.*l*

4.*r* Running rollers arranged on the right for guiding the watercraft 2, 2.2 relative to the frame 3, mounted on the right-hand mount 13.*r*

5.*l* Running rollers arranged on the left for guiding the frame 3 relative to the carrying structure 40 of the mother ship 1

5.*r* Running rollers arranged on the right for guiding the frame 3 relative to the carrying structure 40 of the mother ship 1

6.*l* Guide rail for holding the running rollers 5.*l* arranged on the left, slide along the left-hand guide rail 6.*l*

6.*r* Guide rail for holding the running rollers 5.*r* arranged on the right, slide along the right-hand guide rail 6.*r*

7.*h* Bearing for the axle 20 of the sprocket pairs 17.*l*.2, 17.*r*.2

7.*v* Bearing for the driveshaft 19 of the sprocket pairs 17.*l*.1, 17.*r*.1

8 Centrally arranged double-roller conveyor chain of the first embodiment, comprises the part-chains 21.1 and 21.2 and the drivers 14.1, 14.2, . . . , is guided over the roller-chain guide rails 12.*o* and 12.*u*

8.*l* Left-hand double-roller conveyor chain of the second embodiment, comprises the part-chains 21.*l*.1 and 21.*l*.2 and the drivers 14.*l*.1, 14.*l*.2, . . . , is guided over the left-hand roller-chain guide rails 12.*l*.*o* and 12.*l*.*u*

8.*r* Right-hand double-roller conveyor chain of the second embodiment, comprises the part-chains 21.*r*.1 and 21.*r*.2 and the drivers 14.*r*.1, 14.*r*.2, . . . , is guided over the right-hand roller-chain guide rails 12.*r*.*o* and 12.*r*.*u*

9 Drive motor for the double-roller conveyor chain 8, 8.*l*, 8.*r*, rotates the drive roller chain 18

10 Hydraulic or pneumatic piston-cylinder unit, acts as an actuator for the frame 3, mounted in an articulated manner on the connecting elements 30 and 31

11 Gripping teeth on the watercraft 2, act as protrusions

11.2 Gripping teeth on the watercraft 2.2, act as further protrusions

12.*o* Upper roller-chain guide rail made of plastic for the upper segment of the centrally arranged double-roller conveyor chain 8

12.*u* Lower roller-chain guide rail made of plastic for the lower segment of the centrally arranged double-roller conveyor chain 8

12.*l*.*o* Left-hand upper roller-chain guide rail made of plastic for the upper segment of the left-hand double-roller conveyor chain 8.*l*

12.*l*.*u* Left-hand lower roller-chain guide rail made of plastic for the lower segment of the left-hand double-roller conveyor chain 8.*l*

12.*r*.*o* Right-hand upper roller-chain guide rail made of plastic for the upper segment of the right-hand double-roller conveyor chain 8.*r*

12.*r*.*u* Right-hand lower roller-chain guide rail made of plastic for the lower segment of the right-hand double-roller conveyor chain 8.*r*

13.*l* Mount for the left-hand running rollers 4.*l*, mounted on the frame 3

13.*r* Mount for the right-hand running rollers 4.*r*, mounted on the frame 3

14.1, 14.2, . . . Sequence of pins between the two part-chains 21.1 and 21.2 of the centrally arranged double-roller conveyor chain 8, act as drivers for the central sequence of gripping teeth 11

14.*l*.1, 14.*l*.2, . . . Sequence of pins between the two part-chains 21.*l*.1 and 21.*l*.2 of the left-hand double-roller conveyor chain 8.*l*, act as drivers for the left-hand sequence of gripping teeth 11.2

14.*r*.1, 14.*r*.2, . . . Sequence of pins between the two part-chains 21.*r*.1 and 21.*r*.2 of the right-hand double-roller conveyor chain 8.*r*, act as drivers for the right-hand sequence of gripping teeth 11.2

15.*l* Left-hand constituent of the holding apparatus for holding the watercraft 2, 2.2 on the frame 3, comprises the contact element 22.*l*, can be moved by the left-hand actuator 22.*l*

15.*r* Right-hand constituent of the holding apparatus for holding the watercraft 2, 2.2 on the frame 3, comprises the contact element 22.*r*, can be moved by the right-hand actuator 22.*r*

16.*l* Guide elements arranged on the left for guiding the watercraft 2, 2.2 along the frame 3, mounted on the left-hand lateral carrier 25.*l*

16.*r* Guide elements arranged on the right for guiding the watercraft 2, 2.2 along the frame 3, mounted on the right-hand lateral carrier 25.*r*

17.1, 17.2 Sprocket pairs for the central double-roller conveyor chain 8

17.*l*.1, 17.*l*.2 Sprocket pairs for the left-hand double-roller conveyor chain 8.*l*

17.*r*.1, 17.*r*.2 Sprocket pairs for the right-hand double-roller conveyor chain 8.*r*

18 Drive roller chain for rotating the sprocket 24 on the shaft 19, is rotated by the motor 9

19 Driveshaft for rotating the sprockets 17.*l*.1, 17.*r*.1, rotated by the drive roller chain 18, supported in the bearing 7.*v*

20 Nondriven axle, on which the sprockets 17.*l*.2, 17.*r*.2 are mounted, supported in the bearing 7.*h*

21.1, 21.2 Part-chains of the centrally arranged double-roller conveyor chain 8

21.*l*.1, 21.*l*.2 Part-chains of the left-hand double-roller conveyor chain 8.*l*

21.*r*.1, 21.*r*.2 Part-chains of the right-hand double-roller conveyor chain 8.*r*

22.*l* Left-hand piston-cylinder unit, moves the left-hand constituent 15.*l* of the holding apparatus back and forth between the releasing position and the holding position, acts as a spring element

22.*r* Right-hand piston-cylinder unit, moves the right-hand constituent 15.*r* of the holding apparatus back and forth between the releasing position and the holding position, acts as a spring element

23.*l* Contact element of the left-hand constituent 15.*l* of the holding apparatus, comes into contact with the boat 2, 2.2, can comprise a running roller

23.*r* Contact element of the right-hand constituent 15.*r* of the holding apparatus, comes into contact with the boat 2, 2.2, can comprise a running roller

24 Sprocket on the shaft 19, is driven by the drive roller chain 18

25.*l*, 25.*r* Lateral carriers of the frame 3, mounted on the horizontal platform 26

26 Horizontal platform of the frame 3, about which the chains 8, 8.*l*, 8.*r* are guided

30 Mechanical connecting element between the hydraulic piston-cylinder unit 10 and the frame 3

31 Mechanical connecting element between the hydraulic piston-cylinder unit 10 and the carrying structure 40 of the mother ship 1

40 Carrying structure of the recovery apparatus, is formed by the carrying structure of the mother ship 1, carries the frame 3

BR Direction of movement of the frame 3 from the recovering position into the parked position, at the same time the direction of movement of the respective upper segment of each chain 8, 8.*l*, 8.*r* relative to the frame 3

FR Coinciding direction of travel of the mother ship 1 and the boat 2, 2.2 to be recovered on the water DWL Design waterline of the mother ship 1

M.8.*l* Central axis of the left-hand double-roller conveyor chain 8.*l*, is located centrally between the left-hand part-chains 21.*l*.1 and 21.*l*.2

M.8.*r* Central axis of the right-hand double-roller conveyor chain 8.*r*, is located centrally between the right-hand part-chains 21.*r*.1 and 21.*r*.2

M.8 Central axis of the centrally arranged double-roller conveyor chain 8, is located centrally between the part-chains 21.1 and 21.2

MW Centerline of the watercraft 2, 2.2

What is claimed is:

1. A recovery apparatus for recovering at least one watercraft, wherein the recovery apparatus comprises:

a carrying structure, a frame held by the carrying structure, an endless chain with a sequence of drivers, and a chain drive, wherein the frame is configured to carry a watercraft to be recovered, wherein the chain is mechanically connected to the frame and is movable relative to the frame along a closed curve, wherein the chain drive is configured to move the chain relative to the frame, and wherein the recovery apparatus is configured to pull a watercraft that is floating on water and is temporarily connected to a driver of the chain out of the water and onto the frame by moving the chain, wherein the recovery apparatus comprises a frame actuator, wherein the frame is linearly movable relative to the carrying structure between a recovering position and a parked position, wherein, when the frame is in the recovering position, the chain is located at least partially under water, and wherein the frame actuator is configured to pull the frame together with the chain and a watercraft temporarily connected to the chain from the recovering position into the parked position.

2. The recovery apparatus of claim 1, comprising a first endless chain and a further endless chain, which are each mechanically connected to the frame, each endless chain comprising a sequence of drivers, and each endless chain movable relative to the frame along a closed curve, wherein the two closed curves are arranged parallel to one another, wherein the first chain and the further chain—in the direction of movement of the frame into the parked position—are arranged alongside one another, and wherein the chain drive is configured to move the first chain and the further chain relative to the frame.

3. The recovery apparatus of claim 2 wherein one driver of the first chain and one driver of the further chain—as seen in the direction of movement of the frame into the parked position—are arranged alongside one another at the same height.

4. The recovery apparatus of claim 1 wherein the recovery apparatus comprises a holding apparatus that is movable relative to the frame between a holding position and a releasing position, wherein the holding apparatus in the holding position prevents a watercraft located on the frame from moving upward relative to the chain and wherein a distance between a watercraft on the frame and the holding apparatus arises in the releasing position.

5. The recovery apparatus of claim 4 wherein the holding apparatus comprises at least one actuator, which pushes a watercraft that is located on the frame downward toward the chain.

6. The recovery apparatus of claim 4 wherein the holding apparatus is mounted on the carrying structure or on the frame and is configured such that a watercraft to be recovered is permitted to move relative to the carrying structure and to the frame in a direction parallel to the direction of movement of the frame into the parked position.

7. The recovery apparatus of claim 1 wherein the recovery apparatus comprises a ramp guide device, the ramp guide device configured to guide the frame in a movement relative to the carrying structure from the recovering position into the parked position.

8. The recovery apparatus of claim 7 wherein the ramp guide device comprises:

a plurality of running rollers, and a rail, wherein the running rollers are mounted on the rail.

9. The recovery apparatus of claim 8 wherein the rail of the ramp guide device is fastened to the carrying structure and the running rollers are fastened to the frame in a rotatable manner.

10. The recovery apparatus of claim 1 wherein the frame comprises a horizontal platform located beneath a watercraft on the frame, wherein an upper segment of the chain is guided along a path above the horizontal platform and a lower segment is guided along a path beneath the horizontal platform.

11. The recovery apparatus of claim 10 wherein the recovery apparatus comprises a chain guide unit for the chain, wherein the chain guide unit is mounted on the frame and the upper segment and/or the lower segment of the chain is guided via the or a chain guide unit.

12. The recovery apparatus of claim 11, comprising a plurality of chains, each of the plurality of chains comprising a chain guide unit.

13. The recovery apparatus of claim 1, wherein the recovery apparatus comprises a watercraft guide device that is mounted on the frame and is configured to guide a watercraft to be recovered along the frame.

14. The recovery apparatus of claim 13 wherein the frame—as seen in the direction of movement—has a U-shaped cross-sectional profile with two lateral carriers, wherein two elements of the watercraft guide device are mounted on the two lateral carriers.

15. The recovery apparatus of claim 1 wherein the frame in the parked position is located entirely above water.

16. The recovery apparatus of claim 1 wherein the frame is configured such that a watercraft located on the frame is located entirely above water when the frame is in the parked position.

17. The recovery apparatus of claim 1 wherein the extent of the frame in the direction of movement is less than the length of a watercraft to be recovered.

18. The recovery apparatus of claim 1 wherein the chain drive is configured to move the chain relative to the frame selectively in a first direction or in a second direction opposite to the first direction, wherein the recovery apparatus is configured to pull a watercraft out of water by moving the frame out of the recovering position into the parked position and by moving the chain in the first direction, and to introduce the watercraft into water by moving the frame out of the parked position into the recovering position and by moving the chain in the second direction.

19. A system comprising the recovery apparatus of claim 1, further, comprising:

a watercraft comprising at least one protrusion that is configured to engage the chain of the recovery apparatus, to be contacted by a driver, and as a result to temporarily connect the watercraft to the chain.

20. The arrangement as claimed in claim 19 wherein the watercraft comprises at least one further protrusion and the recovery apparatus comprises a further chain with a further sequence of drivers, wherein the protrusion and the further protrusion —as seen in the direction of movement of the frame into the parked position—are arranged alongside one another, and wherein the further protrusion is configured to engage in the further chain, to be contacted by a further driver, and as a result to temporarily connect the watercraft to the further chain.

21. A ship having a carrying structure and the recovery apparatus of claim 1, wherein the carrying structure of the ship is the carrying structure of the recovery apparatus.

22. A method of recovering at least one watercraft using a recovery apparatus having a carrying structure, a frame held by the carrying structure, an endless chain that is mechanically connected to the frame and comprises a sequence of drivers, and a chain drive, wherein the method comprises:

moving, with the chain drive, the chain relative to the frame along a closed curve, connecting the watercraft floating on water temporarily to a driver of the chain, pulling, with the recovery apparatus, the temporarily connected watercraft out of water and onto the frame by moving the chain, and carrying, with the frame, the watercraft out of water, wherein the recovery apparatus comprises a frame actuator, wherein the frame is linearly movable relative to the carrying structure between a recovering position and a parked position, wherein said pulling step comprises the steps in which the frame is moved into the recovering position such that the chain is located at least partially under water, and wherein the frame actuator pulls the frame together with the chain and the watercraft temporarily connected to the chain from the recovering position into the parked position.

23. The method of claim 22 wherein the two steps in which the recovery apparatus pulls the watercraft onto the frame by moving the chain and in which the frame actuator pulls the frame together with the watercraft into the parked position are carried out in a temporally overlapping manner.

24. The method claim 22 wherein the recovery apparatus comprises a ramp guide device, wherein the step in which the recovery apparatus pulls the watercraft out of the water and onto the frame additionally comprises the step in which the ramp guide device guides the frame from the recovering position into the parked position during the movement relative to the carrying structure.

25. The method of claim 22 wherein when the watercraft reaches a predetermined position relative to the frame the step in which the chain drive moves the chain is triggered.

* * * * *